US009315316B2

(12) United States Patent
Babcock

(10) Patent No.: US 9,315,316 B2
(45) Date of Patent: Apr. 19, 2016

(54) WATER-RESISTANT CLAMSHELL CARTON

(71) Applicant: Kenneth R. Babcock, Long Beach, CA (US)

(72) Inventor: Kenneth R. Babcock, Long Beach, CA (US)

( * ) Notice: Subject to any disclaimer, the term of this patent is extended or adjusted under 35 U.S.C. 154(b) by 0 days.

(21) Appl. No.: 13/800,300

(22) Filed: Mar. 13, 2013

(65) Prior Publication Data

US 2014/0262891 A1 Sep. 18, 2014

(51) Int. Cl.

| | |
|---|---|
| ***B65D 85/04*** | (2006.01) |
| ***B65D 5/00*** | (2006.01) |
| ***B65D 5/44*** | (2006.01) |
| ***B65D 5/66*** | (2006.01) |
| ***B65D 5/72*** | (2006.01) |
| ***B65H 49/08*** | (2006.01) |
| ***B65H 55/04*** | (2006.01) |
| *B65B 5/02* | (2006.01) |
| *B65B 25/24* | (2006.01) |

(52) U.S. Cl.

CPC ..... *B65D 85/04* (2013.01); *B65D 5/443* (2013.01); *B65D 5/6658* (2013.01); *B65D 5/725* (2013.01); *B65H 49/08* (2013.01); *B65H 55/046* (2013.01); *B65B 5/024* (2013.01); *B65B 25/24* (2013.01); *B65H 2701/36* (2013.01)

(58) Field of Classification Search

CPC ..... B65D 85/04; B65H 49/08; B65H 57/12

USPC ..... 242/588.4; 206/395, 397, 409, 411, 206/225, 389, 407, 408, 413, 415

See application file for complete search history.

(56) References Cited

U.S. PATENT DOCUMENTS

| | | | | | |
|---|---|---|---|---|---|
| 1,718,872 | A | * | 6/1929 | Ortiz | 229/125 |
| 2,020,663 | A | * | 11/1935 | Stapleford | 206/388 |
| 2,839,236 | A | * | 6/1958 | Dunning | 229/145 |
| 3,038,463 | A | * | 6/1962 | Daymon | 126/682 |
| 3,112,058 | A | * | 11/1963 | Martin | B65D 5/22 206/445 |
| 3,933,300 | A | * | 1/1976 | Dempster | B65D 5/18 229/117.17 |
| 3,982,712 | A | * | 9/1976 | Bassett | 242/129 |
| 4,069,917 | A | * | 1/1978 | Stollberg et al. | 206/423 |
| 4,373,687 | A | * | 2/1983 | Zicko | 242/163 |
| 4,549,689 | A | * | 10/1985 | Bailey | B65D 83/0882 206/395 |
| 4,877,178 | A | * | 10/1989 | Eisman | 229/114 |
| 5,205,476 | A | * | 4/1993 | Sorenson | 229/114 |
| 5,553,772 | A | * | 9/1996 | Jensen | 229/148 |
| 5,909,841 | A | * | 6/1999 | Andrews et al. | 229/125.15 |
| 5,979,812 | A | * | 11/1999 | Kotzur et al. | 242/163 |
| 6,016,911 | A | * | 1/2000 | Chen | B65D 5/46024 206/395 |

(Continued)

*Primary Examiner* — J. Gregory Pickett
*Assistant Examiner* — Jennifer N Zettl
(74) *Attorney, Agent, or Firm* — Cook Alex Ltd.

(57) ABSTRACT

A carton suitable for packaging a coil of wire with a payout tube has a cover for selectably closing the open side of a five-sided clamshell. The carton can be loaded by placing the coil and payout tube on the cover and then closing the clamshell over the coil. The clamshell has a payout tube aperture and an entryway that permits the clamshell to fit down over the payout tube with the tube extending through the clamshell. Doors open to permit initial access of the tube to the aperture during closure of the clamshell. The doors then close to prevent the tube from becoming dislodged from the aperture. Guide flaps constrain the coil during closure of the clamshell. The final panel of the carton to be closed is secured on all of its free edges to prevent inadvertent opening of the carton. Fold lines are reinforced with reinforcing tape. The carton blank is laid out to have a waste percentage of less than 20%.

3 Claims, 7 Drawing Sheets

(56) References Cited

U.S. PATENT DOCUMENTS 6,086,012 A * 7/2000 Kotzur et al. ..... 242/588.4
6,564,942 B1 * 5/2003 Shiffler et al. ..... 206/395
6,742,690 B2 * 6/2004 Gerulski et al. ..... 225/47
6,817,162 B1 * 11/2004 Gerulski et al. ..... 53/458
7,007,799 B2 * 3/2006 Cote ..... 206/409
7,530,460 B2 * 5/2009 Lewis et al. ..... 206/409
7,743,970 B2 * 6/2010 Bates et al. ..... 229/117.16
8,596,455 B2 * 12/2013 Babcock et al. ..... 206/395

* cited by examiner

WATER-RESISTANT CLAMSHELL CARTON

BACKGROUND OF THE INVENTION

The present invention concerns cartons for packaging filamentary materials such as wire, cable and rope. Such materials are typically wound into toroidal coils having an open center and a radial hole extending from the inside to the outside of the coil. A payout tube may be inserted into the radial hole to facilitate withdrawal of the wire or cable from the inside of the coil. Coils of this type are described in U.S. Pat. No. 5,979,812, the disclosure of which is incorporated herein by reference.

The advantages of non-reel cartons for packaging coils of filamentary materials are set forth in U.S. patent application Ser. No. 11/675,755, filed Feb. 16, 2007, the disclosure of which is incorporated herein by reference. The present disclosure concerns cartons that are water resistant, fully recyclable and can be readily set up and packed largely by hand.

One of the challenges of making a recyclable carton that is water-resistant is providing a way to assemble the carton and pack the coils and payout tubes therein. Water-resistant, recyclable paperboard materials are known. One example is wax alternative material. Such material includes paper inner and outer liners attached to a central, corrugated medium. The liners and medium are treated with a chemical that makes the paperboard water-resistant. However, the chemical treatment of the finished board materials also makes it difficult to create carton joints that are glued together. While glued carton joints can be made with wax alternative material, known glues that will work on wax alternative material are not water-resistant. Exposure to moisture degrades the glue. Thus, any carton made of wax alternative material and that contains glue joints is susceptible to failure when glue joints get wet.

The general unavailability of glue joints in cartons made of wax alternative material greatly complicates carton assembly. While finishing devices associated with the coil winding machines are known that can automatically set up a carton and insert a completed coil and payout tube into the carton, such finishing devices require large capital expenditures. This expense demonstrates the need for a carton that can be quickly set up and filled by hand. U.S. Pat. No. 7,007,799 shows a carton that can be set up by hand. However, the structure for retaining the payout tube in the carton of the U.S. Pat. No. 7,077,799 is susceptible to failure and it lacks guide flaps of sufficient height to reliably align any dangling loops of a wire coil or guide a portion of the carton during closure.

SUMMARY OF THE INVENTION

The present invention concerns a carton for carrying or packaging wire, cable or other filamentary material. The carton has a clamshell formed by a plurality of panels including at least one top panel, at least one bottom panel, a side panel and front and rear panels. The clamshell has an open side which is selectably closed by a cover. The panels collectively define an enclosure which receives the filamentary material. The filamentary material is typically wound in a coil having a radial hole in which a payout tube is disposed. Either the clamshell or the cover has a panel designated as a payout panel which defines an entry edge and an aperture remote from the entry edge. The aperture is sized to permit a portion of the payout tube to extend through the aperture. There is an entryway defined in the payout panel. The entryway extends from an entry edge of the payout panel to the aperture. The entryway is sized to permit a portion of the payout tube to extend through the entryway. At least one door is connected to the payout panel for movement between open and closed positions. When the door is in the open position the entryway permits passage of the payout tube in a direction radial of the tube from the entry edge to the aperture. When the door is in a closed position the door prevents passage of the payout tube from the aperture.

In another aspect of the invention, the distance from the open side of the clamshell to the closed side defines the depth of the clamshell. The cover includes a main plate having first and second guide flaps connected to it by fold lines. Each guide flap has a maximum height from a free edge thereof to its fold line that is at least 80% of the depth of the clamshell. This provides a guide flap that constrains the coil of wire prior to the clamshell closing on the coil and guides the clamshell onto the cover during closing.

In a further aspect of the invention, there is a final panel attached to either the cover or the clamshell. It is the last panel to be closed on a filled carton. The final panel has a plurality of edges each of which includes a locking member which positively interlocks with the other of the cover and clamshell. This prevents inadvertent opening of the carton in case it is dropped or jostled.

Yet another aspect of the invention is the use of reinforcing tape at or near at least some of the fold lines. The panels are made of inner and outer liners connected to a corrugated medium with a reinforcing tape connected to the corrugated medium adjacent at least one of the fold lines.

The carton lends itself to an improved method of packaging a coil or wire therein. The method includes the steps of folding the blank into a five-sided clamshell after which a sixth side of the blank is laid on a horizontal surface. A coil of filamentary material is placed on the sixth side with a payout tube extending from the coil. Next the clamshell cover is closed over the coil and payout tube. As the clamshell closes the payout tube fits into an through the entryway from the entry edge to the payout tube aperture. The payout tube end up extending through the payout tube aperture in the clamshell. Finally, the sixth side is secured to the clamshell. In this manner the carton is essentially built up and closed down over and around the coil rather the coil being lifted and lowered into the open top of a carton.

The method may further include the steps of providing a pair of guide flaps connected to the sixth side and folding the guide flaps up after placing the coil on the sixth side. This partially encloses the coil and serves to both prevent the coil from interfering with closing of the clamshell and guide the clamshell onto the cover.

The present invention also concerns a blank for a carton having no glued joints. The blank has a rectangular portion having a length and a width. The rectangular portion defines a plurality of panels. The panels are foldable into a five-sided clamshell having an open side. A cover is connected by a fold line to a side defining either the length or width of the rectangular portion by a fold line. The cover extends within either the length or width of the rectangular portion such that the waste percentage of the blank is less than 20 percent. Considerable cost savings are realized as a result of this efficient usage of the stock material.

DETAILED DESCRIPTION OF THE DISCLOSURE

Figure 1:
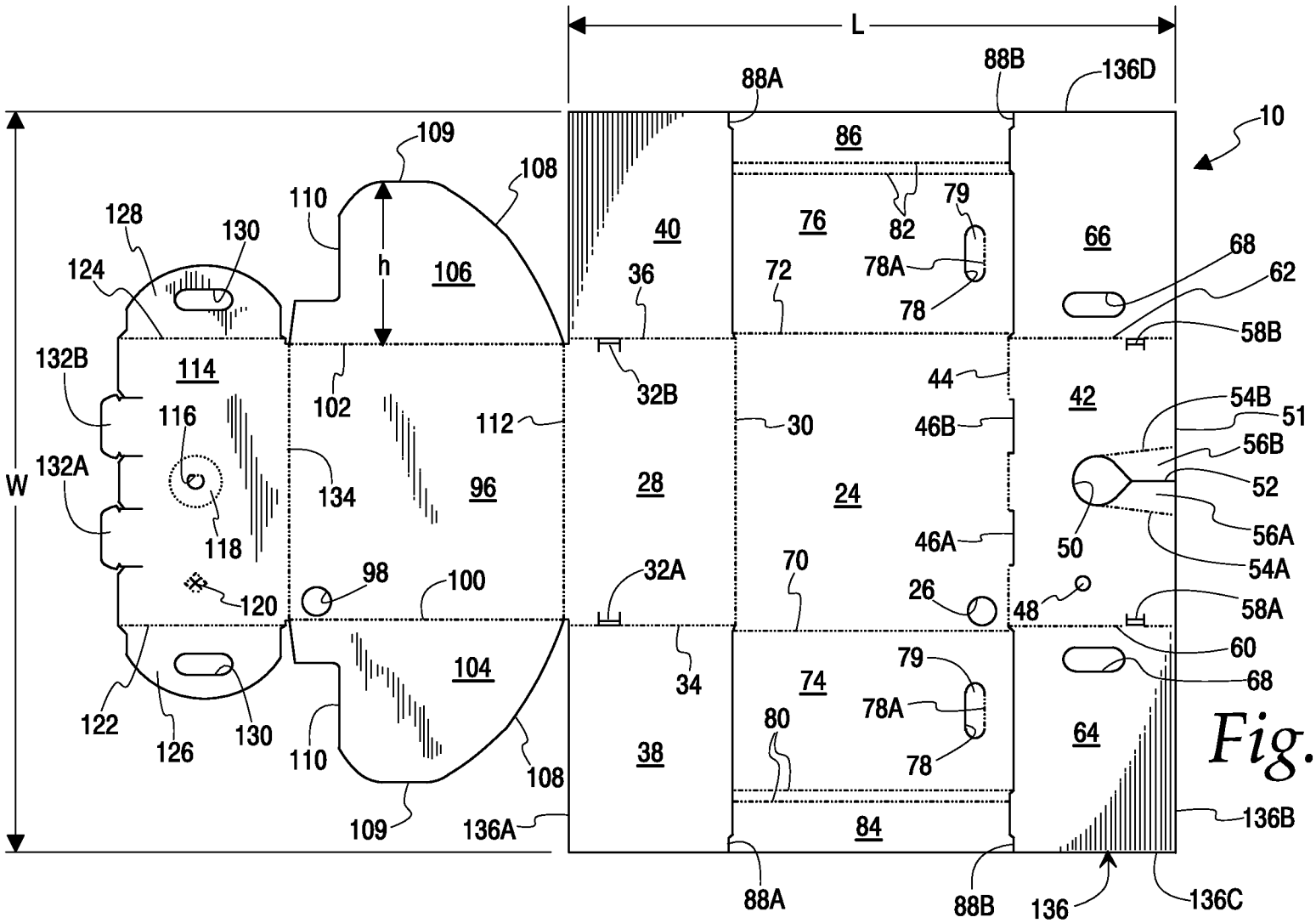
FIG. 1 is a plan view of a carton blank according to the present invention, with fold lines shown in dotted lines and with boundary edges and fully cut through portions shown in solid lines.
Figures 2, 3:
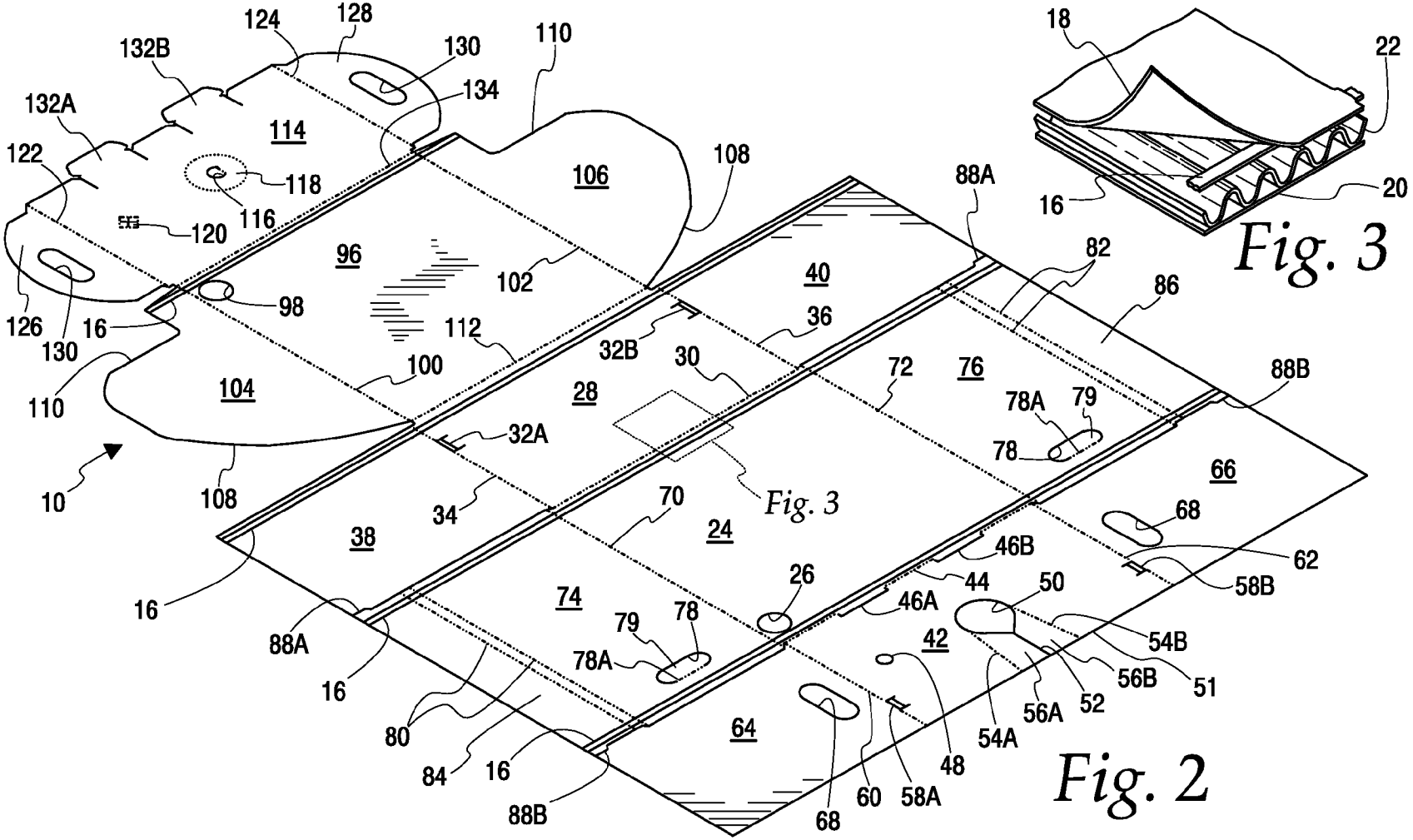
FIG. 2 is a perspective view of the carton blank of FIG. 1, oriented and ready for assembly, with the front of the carton in the foreground and with reinforcing tape shown schematically at several of the boundary edges and fold lines.
FIG. 3 is an enlarged detail of the portion of the carton outlined in FIG. 2 and labeled "FIG. 3", and is a partially exploded section through the carton stock, showing its construction and the reinforcing tape.
Figure 15:
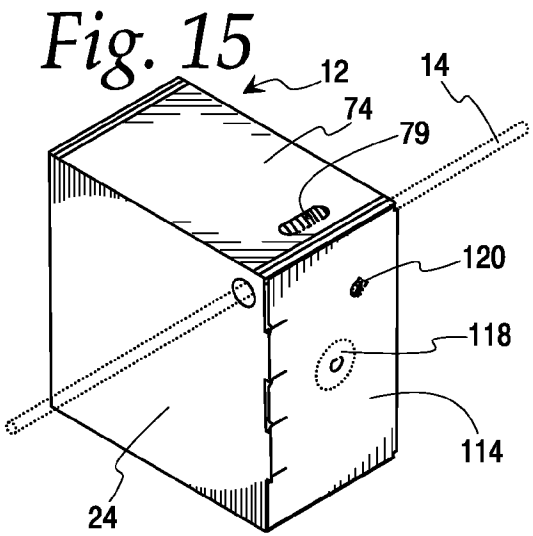
FIG. 15 is a perspective view of the fully assembled carton, rotated from the position of FIG. 14 to an upright position for use, with an optional rod of a dispensing rack extending through the carton.

FIGS. 1 and 2 illustrate a carton blank 10 for the carton of the present invention. A carton blank shows the carton at one stage of its manufacture wherein it is a completely flat sheet of stock material, cut and perforated and ready for assembly, but prior to any assembly steps. In FIG. 1 the solid lines indicate portions that are either fully cut through the stock or are boundary lines. Dotted lines indicate perforations. Fold lines are indicated by combined dotted and dashed lines. However, in figures showing parts folded about fold lines, the fold lines are then shown as solid lines to indicate a corner of the carton. Also, portions of the carton will be designated herein as top, bottom, left, right, front and rear. It will be understood that these designations are for reference purposes only and the carton could be oriented in any manner that meets a user's needs. Top, bottom, left and right are designated from the viewpoint of an observer looking at the finished carton 12 oriented as shown in FIG. 15, with the front being the portion in the right foreground. FIG. 15 is generally how the finished carton 12 would look if hung on a rod 14 of an electrician's dispensing rack.

The carton blank 10 is preferably made of wax alternative material. Suppliers of this material include Spectra-Kote Corp. of Gettysburg, Pa. and Wisconsin Packaging Corp. of Fort Atkinson, Wis. U.S. Pat. No. 7,429,309, the disclosure of which in incorporated herein by reference, describes such a material. Other materials could be used, such as corrugated plastic.

Some of the fold lines and boundary edges of the blank are strengthened by elongated strips of reinforcing tape 16. It is pointed out that only FIGS. 2 and 3 illustrate the reinforcing tape. Also, the showing of the tape 16 in FIG. 2 is diagrammatic in that the tape is embedded in the interior of the sheet stock and thus is not visible from either the inside or outside of the container. This can be seen in the detail view of FIG. 3. The stock material of the blank 10 is preferably formed from an inner liner 18, an outer liner 20, both adhered to an intermediate corrugated medium 22. The corrugations run horizontally as seen in FIG. 1. This provides sufficient strength to the hinge lines 100, 102 of the guide flaps described below. The liners 18, and corrugated medium 22 are preferably made of kraft paper treated to render them a non-wicking, water-resistant, wax alternative material. The reinforcing tape 16 is shown between the inner liner 18 and the medium 22. Alternately the tape could be on the other side of the medium, or it could be on both sides of the medium. In any event, for clarity in the drawings the reinforcing tape is omitted in all but FIGS. 2 and 3. This is to avoid confusion in the drawings over what are panel boundary edges and fold lines and what are edges of the reinforcing tape. It will be understood that multiple strips of the tape are preferably located as shown in FIGS. 2 and 3, even though the tape is not shown in the other figures. The tape could be, by way of example and not by limitation, the tape sold by Adalis Corporation of Vancouver, Wash. under their trademark Sesame®. Note that the reinforcing tape 16 is located near the fold lines of the blank 10. It also is laid out perpendicular to the corrugations. It has been found that this arrangement of the reinforcing tape and corrugations provides a carton that will not burst even if dropped or thrown with a heavy coil of wire therein.

The carton includes a plurality of panels. Each panel has an interior surface and an exterior surface. In FIG. 1 the interior surface is visible. In the illustrated embodiment when the panels are assembled they form a six-sided enclosure which is made up of a five-sided clamshell and a cover which selectably closes an otherwise open side of the clamshell. The top and bottom sides of the carton include multiple layers or panels of stock material. This is to provide adequate strength to support the weight of a coil of wire and to permit the filled container to be lifted and moved about without damage to the carton or coil.

The central backbone of the blank 10 includes a left side panel 24 which has a shaft opening 26 formed in one corner thereof. The left side panel 24 is joined to a rear panel 28 by a first fold line 30. Two notches 32A, 32B are cut adjacent second and third fold lines 34 and 36 at the top and bottom edges of the rear panel 28. The second and third fold lines 34, 36 respectively attach a top inner flap 38 and a bottom inner flap 40 to the rear panel 28. Opposite the rear panel 28 the left side panel 24 is joined to a front interior panel 42 by a fourth fold line 44. The fourth fold line 44 is partially defined by slits 46A, 46B which extend fully through the stock material. A wire retention hole 48 is cut in the front interior panel.

Figure 11:
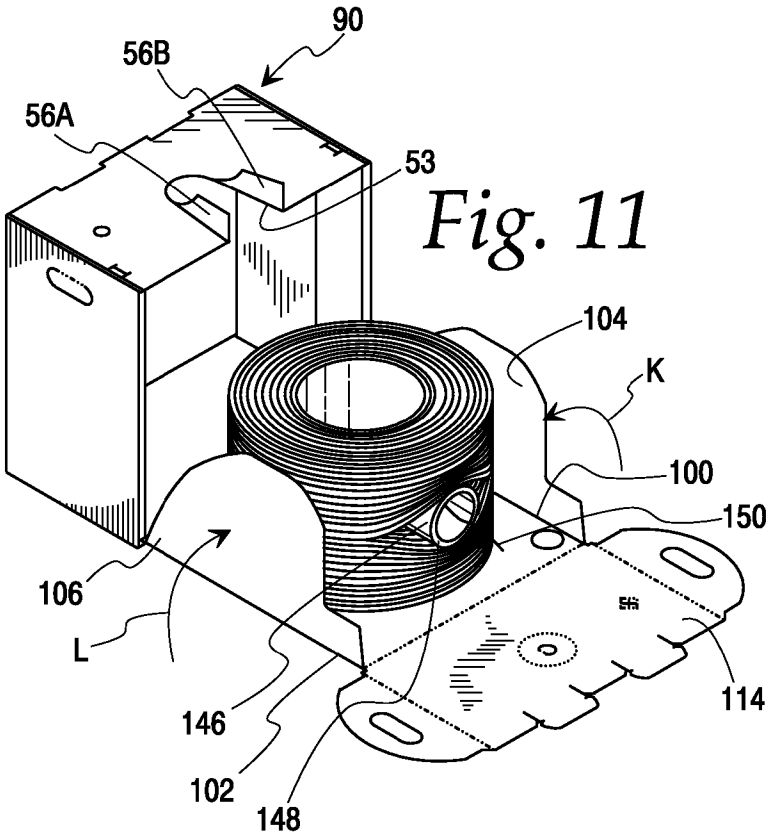
FIG. 11 is a perspective view similar to FIG. 10, showing the bottom guide flap and the top guide flap folded up about the coil, and the doors to the payout tube opening folded out to an open position.
Figure 10:
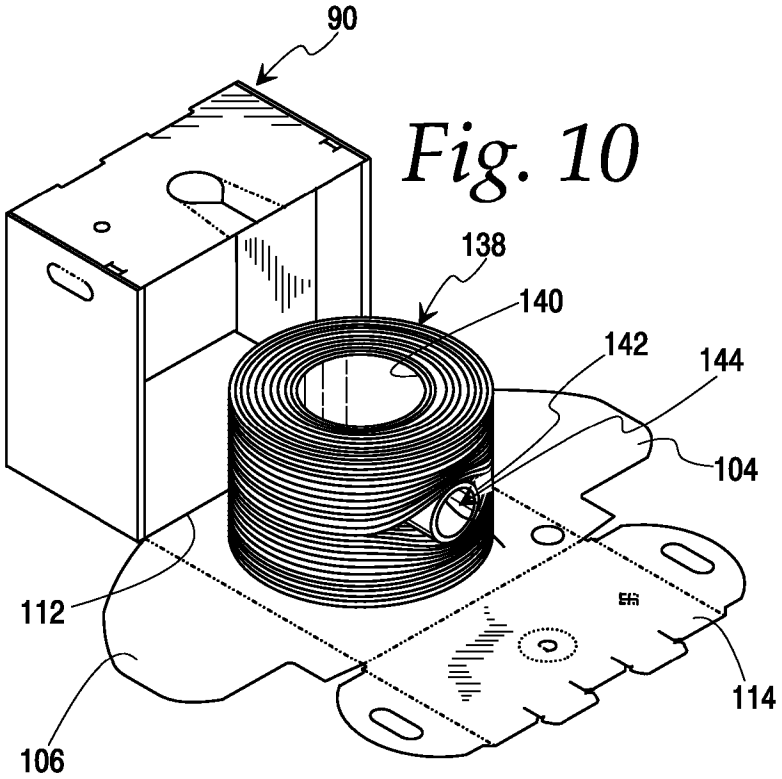
FIG. 10 is a perspective view showing the carton rotated from its position in FIG. 9 so the clamshell opening is vertical and the right side panel is horizontal, with a coil of wire placed on the right side panel.
Figure 14:
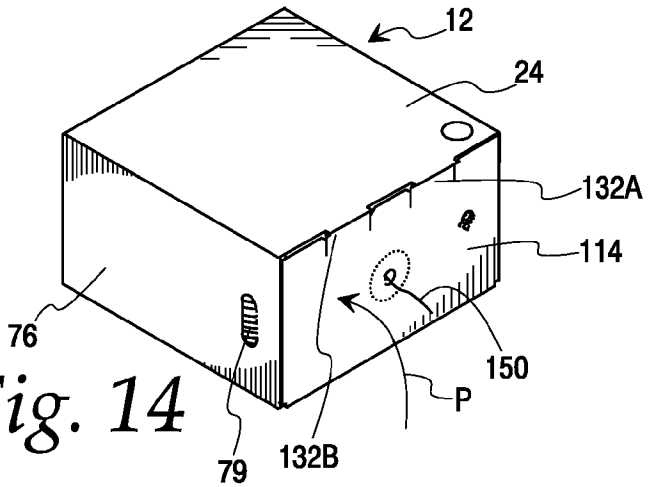
FIG. 14 is a perspective view similar to FIG. 13 showing final steps for closing the cover, namely, closing the front exterior panel and tucking in the retainer tabs.

The front interior panel 42 has a payout tube retention aperture 50 for receiving a payout tube, as will be shown and described below. Thus, in this embodiment the front interior panel 42 serves as a payout panel. It will be understood that other panels, including those in the cover, could have the payout retention tube aperture therein and thus serve as the payout panel. Further, the payout panel has an entry edge 51 with an access slit 52 extending from the entry edge to the payout tube retention aperture 50. Door fold lines 54A, 54B extend on either side of the access slit 52. The fold lines 54A, 54B are generally tangential to the tear-drop shaped aperture 50. The door fold lines 54A, 54B define a pair of doors 56A, 56B that can pivot about the fold lines 54A, 54B to open and define an entryway 53 (FIG. 11). The entryway 53 is sized to allow the payout panel (which in this case is the front interior panel 42) to close over and around a payout tube, as will be described below. Once the payout tube extends through the aperture 50, the doors 56A, 56B are closed behind the payout tube to lock it in place.

Two notches 58A, 58B are cut adjacent fifth and sixth fold lines 60 and 62 at the top and bottom edges of the front interior panel 42. The fifth and sixth fold lines 60, 62 respectively attach a top middle flap 64 and a bottom middle flap 66 to the front interior panel 42. The top and bottom middle flaps each have an oval hand hold opening 68 formed therein. The entire perimeter of the openings 68 is fully cut through and the resulting slug is punched out and removed, leaving an open hole.

Seventh and eighth fold lines 70 and 72 respectively attach a top outer panel 74 and a bottom outer panel 76 to the left side panel 24 at the top and bottom edges thereof. The top and bottom outer panels each have an oval hand hold opening 78 formed therein. Unlike the fully cut out openings 68, the openings 78 have one long side 78A which is not cut but instead forms a fold line for finger cushions 79. The finger cushions 79 ultimately get folded about side 78A into and through openings 130 and openings 68, thereby locking the top and bottom outer panels 74, 76 to the top and bottom middle flaps 64, 66 and to the top and bottom tuck flaps 126, 128. Ninth and tenth fold lines 80 and 82 respectively attach a top locking plate 84 and a bottom locking plate 86 to the top and bottom outer panels 74, 76. Fold lines 80 and 82 are double folds. The sides of the locking plates each have a pair of tabs 88A, 88B formed at their outer corners.

Figure 9:
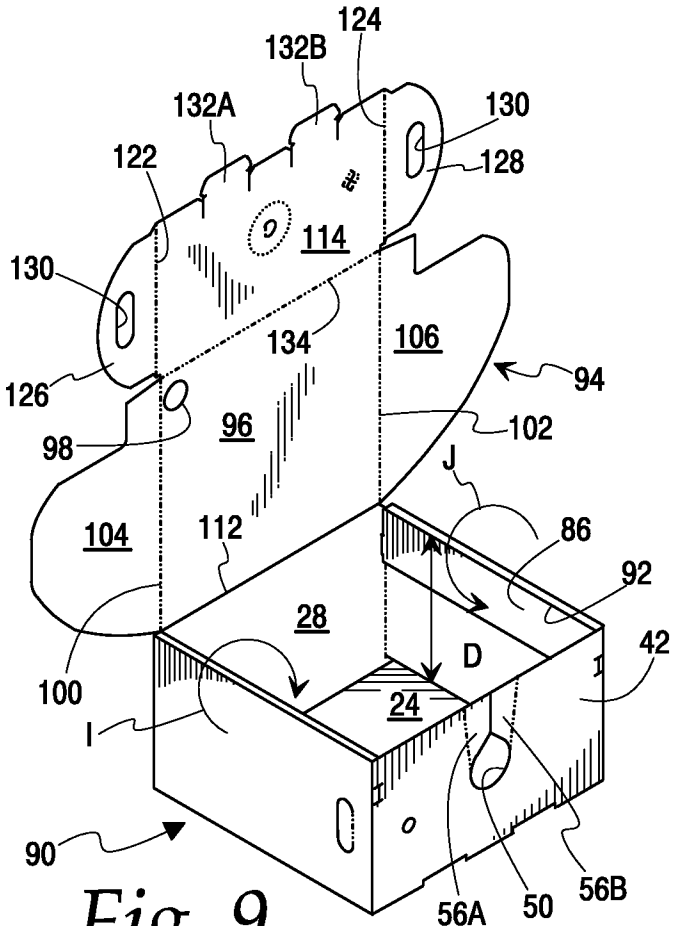
FIG. 9 is a perspective view of the fully assembled clamshell, with the top and bottom locking plates tucked inside the clamshell to lock the top and bottom inner and middle flaps to the top and bottom outer panels.
Figure 8:
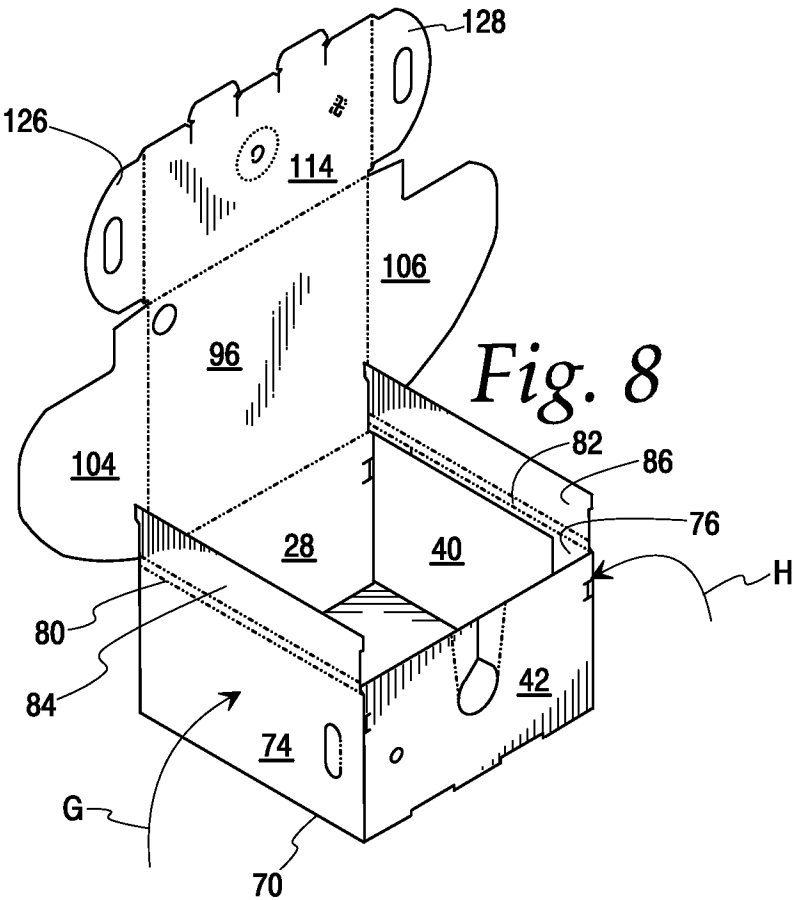
FIG. 8 is a perspective view similar to FIG. 7 showing the top and bottom outer panels folded up to their assembled positions.

Collectively the panels and flaps described above can be assembled into a clamshell shown generally at 90 in FIG. 9. In this embodiment the clamshell is a five-sided enclosure whose base is formed by the left side panel 24 and whose sides are formed by the rear panel 28, the top and bottom inner flaps 38, 40, the front interior panel 42, the top and bottom middle flaps 64, 66, the top and bottom outer panels 74, 76 and the top and bottom locking plates 84, 86. The clamshell has an open side 92 opposite the left side panel 24. The front interior panel includes the payout tube retention opening 50 and access thereto is provided by the pivotable doors 56A, 56B.

The open side 92 of the clamshell is closed by a cover 94. In the illustrated embodiment the cover is formed by a right side panel 96, which has a shaft opening 98 formed in one corner thereof. After final assembly the shaft opening 98 is aligned with shaft opening 26 to permit the rod or shaft 14 (FIG. 15) of a wire dispensing rack to extend through the carton for supporting the carton on the rack. The right side panel 96 is the main plate of the cover. Eleventh and twelfth fold lines 100 and 102 respectively attach a top guide flap 104 and a bottom guide flap 106 to the right side panel 96. The guide flaps have curved edges 108 that facilitate insertion of these flaps into the clamshell. The flaps have free edges 109 that are a distance h (FIG. 1) from the respective fold line 100 or 102. Cutout portions at 110 provide clearance for providing access to the hand hold openings. The cover 94 is preferably attached to the clamshell, although alternately the cover could be made separate from the clamshell. In this embodiment the right side panel 96 is joined to the rear panel 28 by a thirteenth fold line 112.

The cover may also include a front exterior panel 114 joined to the right side panel 96. The front exterior panel in the finished carton lies in front of the front interior panel 42 where it can protect the payout tube opening 50, especially during shipment of the filled carton. Access to the payout tube during dispensing of wire may be had through a hole 116. Alternately, a circular punch out 118 defined by perforations may be removed from the front exterior panel to provide greater access to the payout tube opening. An X-shaped perforation 120 can be used to stuff the end of the wire into after use to hold the wire end to prevent it from falling back into the carton or inadvertently getting pulled out. The X-shaped perforation 120 in a finished carton aligns with the wire retention hole 48 in the front interior panel 42.

The top and bottom edges of the front exterior panel 114 are joined by fourteenth and fifteenth fold lines 122, 124 to a top tuck flap 126 and a bottom tuck flap 128. The tuck flaps each have a hand hold opening 130 formed therein. The edges of the tuck flaps are curved to facilitate tucking them between the front interior panel 42 and the top and bottom outer panels 74, 76. The last feature of the front exterior panel 114 is a pair of closing tabs 132A, 132B. These are sized and aligned to fit into the slits 46A, 46B in the fourth fold line 44 as will be explained below. The front exterior panel is joined to the right side panel 96 by a sixteenth fold line 134.

Looking at FIG. 1 it can be seen that the panels that make up the clamshell 90 are the left side panel 24, the rear panel 28, the top and bottom inner flaps 38, 40, the front interior panel 42, the top and bottom middle flaps 64, 66, the top and bottom outer panels 74, 76 and the top and bottom locking plates 84, 86. Collectively these panels form a rectangular portion 136 of the carton blank 10. The rectangular portion has a length L defined by edges 136A, 136B and a width W defined by edges 136C, 136D. The cover 94 includes right side panel 96, top and bottom guide flaps 104,106, front exterior panel 114 and the tuck flaps 126, 128. The cover is attached by the thirteenth fold line 112 to one of the length and width of the rectangular portion. In the illustrated embodiment the cover is attached to the width of the rectangular portion, but it could be otherwise. In this case, the cover 94 extends within the width of the rectangular portion defined by edges 136C, D. If the cover were attached to the length of the rectangular portion, it would be contained within the length defined by the edges 136A, B. Confining the cover within the width or length, as the case may be, minimizes the waste percentage of the blank. With the limits for the rectangular portion and the cover as described, the waste percentage of the blank is less than 20 percent. This, of course, minimizes the cost of the carton.

Figure 4:
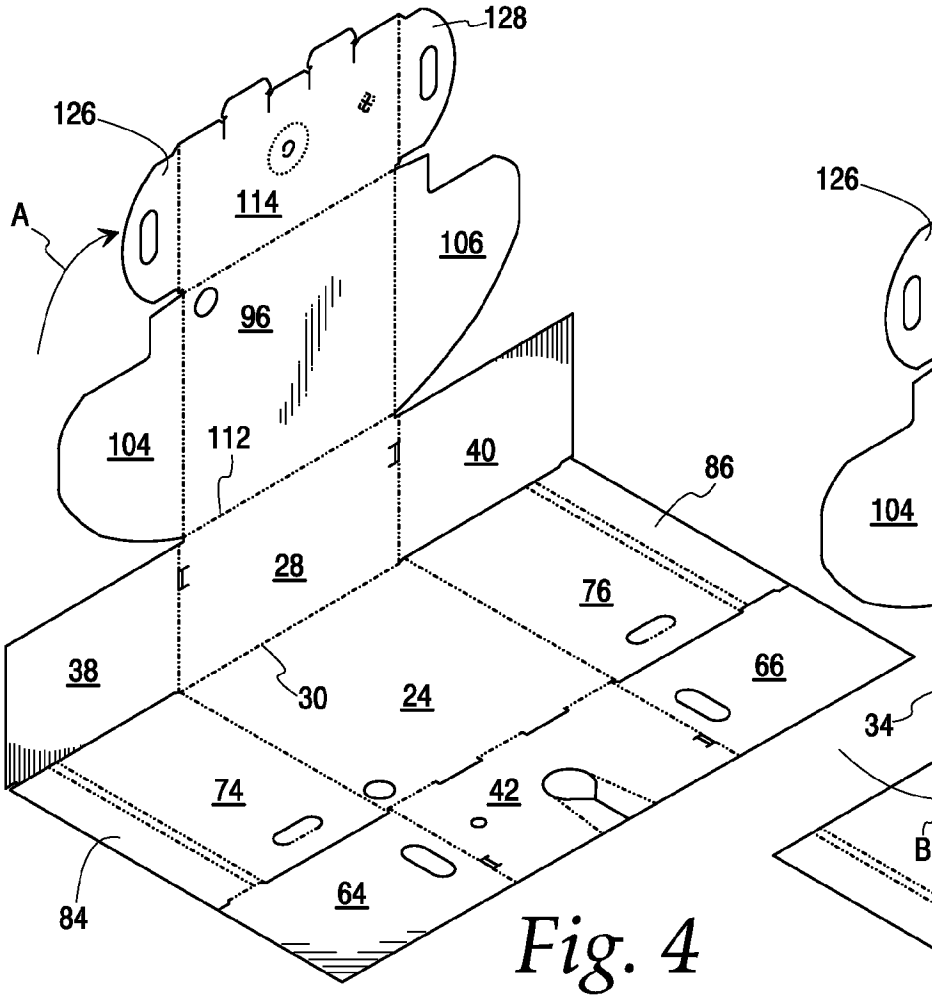
FIG. 4 is a perspective view of the carton, after the first step of the clamshell assembly process, which is folding the rear panel and its attachments up about the first fold line.
Figure 7:
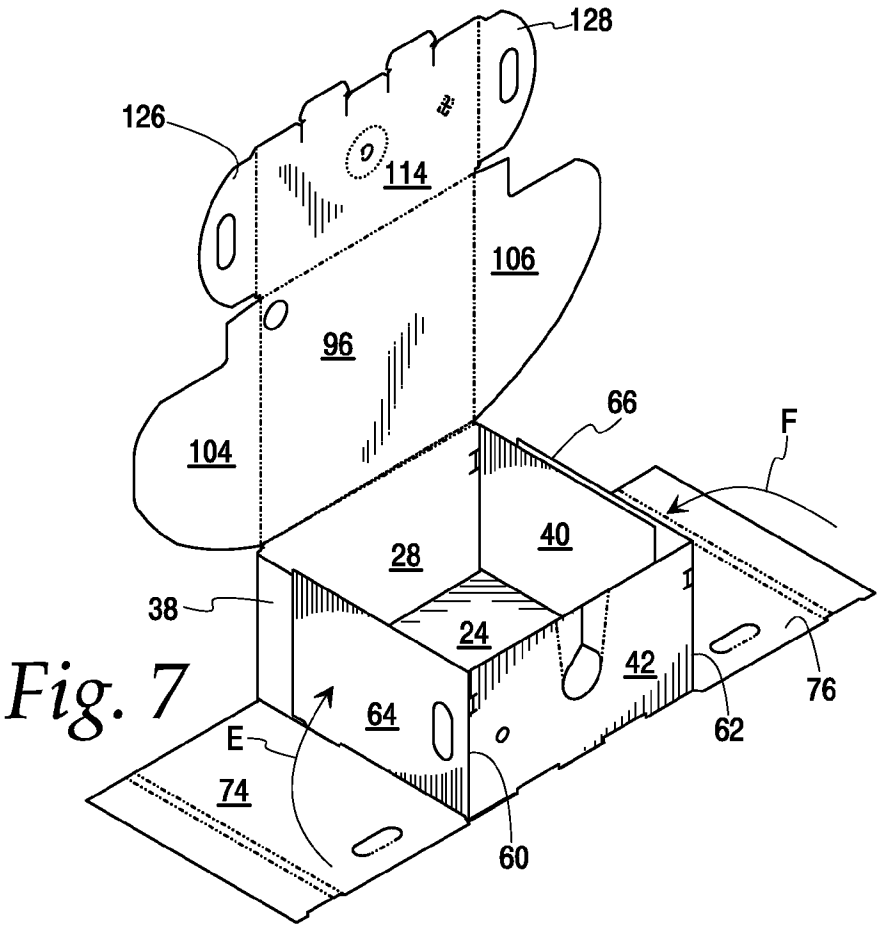
FIG. 7 is a perspective view similar to FIG. 6 showing the top and bottom middle flaps folded in to their assembled positions.
Figure 6:
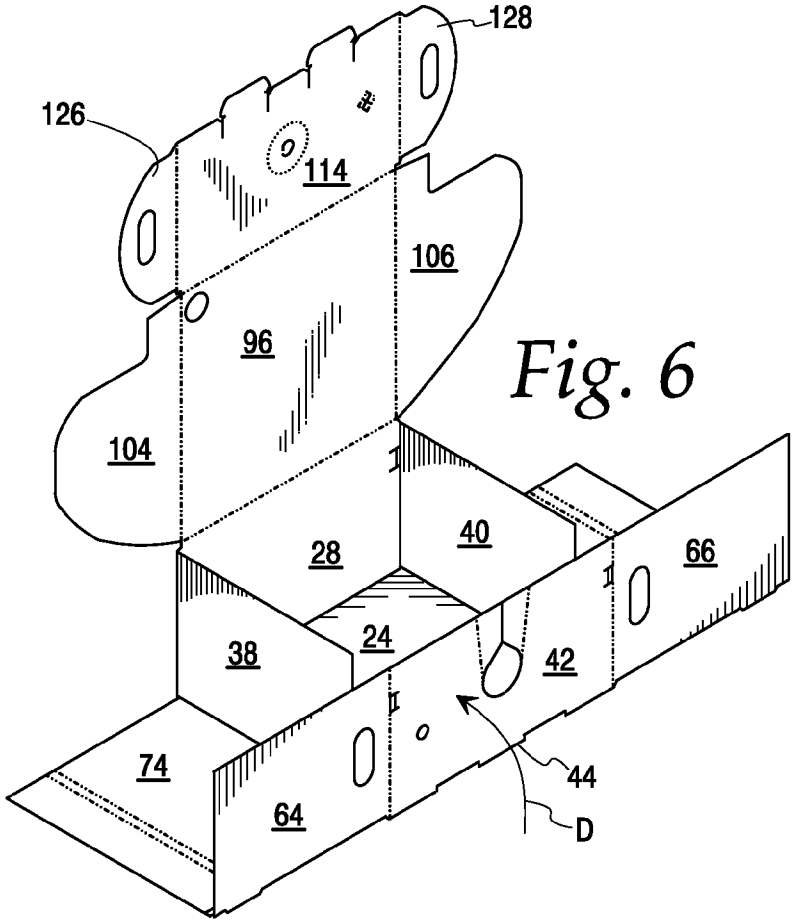
FIG. 6 is a perspective view similar to FIG. 5 showing the front interior panel folded up.

The steps for assembly and filling of the carton will now be described. Generally the clamshell is assembled first. The blank 10 is laid flat, preferably on a horizontal work surface such as a table, counter or the like. The assembler folds the rear panel 28 up about first fold line 30 as indicated by arrow A in FIG. 4. Unless otherwise indicated in these assembly steps, the term "fold" is meant to indicate a 90° movement. This first fold carries the rear panel 28, the top and bottom inner flaps 38, 40 and all of the cover 94 pieces off the work surface. For convenience of illustration the cover pieces are shown in a vertical plane in FIGS. 4-9 but it will be understood that subsequent assembly steps for the clamshell do not require the cover pieces to be held in a vertical plane. As a practical matter the cover pieces will likely fold down about the thirteenth fold line 112 while the remainder of the clamshell is assembled.

Figure 5:
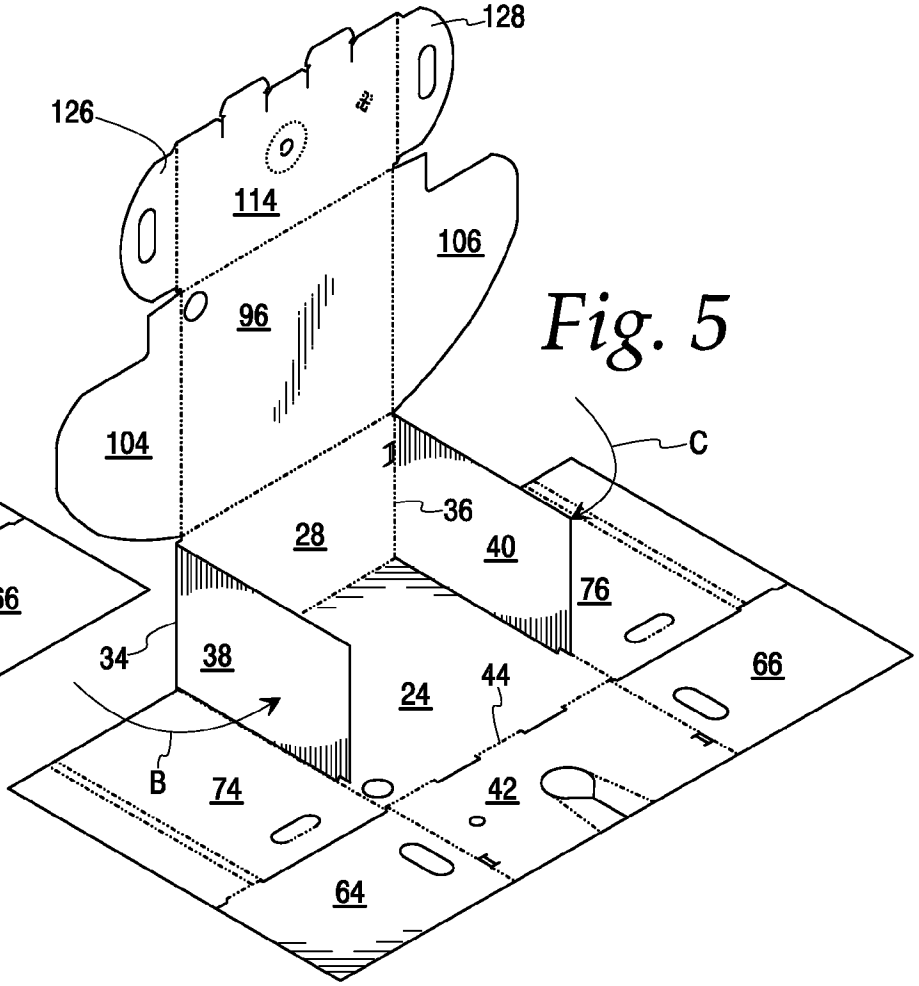
FIG. 5 is a perspective view of the partially assembled clamshell, with the top and bottom inner flaps folded in about the second and third fold lines.

Next the assembler folds the top inner flap 38 in about second fold line 34 as indicated by arrow B in FIG. 5. At the same time, or shortly thereafter, the assembler folds the bottom inner flap 40 in about third fold line 36 and indicated by arrow C in FIG. 5. These steps are followed by folding the front interior panel 42 up about fourth fold line 44. As indicated by arrow D in FIG. 6, this movement will carry the front interior panel 42 and its attached top and bottom middle flaps 64, 66 to a vertical plane. From there the assembler folds the top middle flap 64 in about fifth fold line 60 as shown by arrow E in FIG. 7. Similarly, bottom middle flap 66 is folded in about sixth fold line 62 as shown by arrow F in FIG. 7. Once this is done the top and bottom middle flaps 64, 66 will stand adjacent to and to the outside of top and bottom inner flaps 38, 40.

At this point the assembler folds the top outer panel 74 up about seventh fold line 70. He or she also folds the bottom outer panel 76 up about eight fold line 72. These folds are indicated by arrows G and H, respectively, in FIG. 8. The clamshell 90 is finished by folding the top locking plate 84 in about the ninth fold line 80 as indicated by arrow I in FIG. 9. Since fold line 80 is a double fold line, this movement is essentially a 180° fold, which wraps the top locking plate over the free edges of both the top inner flap 38 and the top middle flap 64. As the top locking plate is pressed against the inside surface of the top inner flap 38, the locking plate tabs 88A, 88B fit into the notches 32A and 58A to retain the top locking plate in its fully folded position. Next the bottom locking plate 86 is similarly folded 180° about tenth fold line 82 as indicated by arrow J in FIG. 9. The locking plate tabs 88A, 88B on bottom locking plate 86 fit into notches 32B and 58B to hold the bottom locking plate in place.

At this point the clamshell 90 is completed. As can be seen in FIG. 9, the clamshell is a five-sided structure defining an enclosure which receives a coil of wire. The clamshell defines an open side 92 which is selectably closed by the cover 94. The clamshell defines a depth which is the distance from the inside surface of left side panel 24 to the top edge of one of the locking panels 84 or 86. The depth of the clamshell is shown at D in FIG. 9. With the clamshell completed, the carton is ready for filling.

The filling process is shown in FIG. 10-14. Starting with FIG. 10, the carton is re-oriented to place the right side panel 96 flat on a horizontal work surface. In this position the clamshell has rear panel 28 horizontal on the work surface while left side panel 24 and the top and bottom panels 38, 40 and 64, 66 and 74, 76 are in a vertical plane. A coil 138 of filamentary material such as wire is placed on the right side panel 96. The coil has a toroidal shape with an axial opening 140 and a radial hole 142. A payout tube 144 extends through the radial hole 142 from the exterior of the coil to the axial opening. The payout tube has a cylindrical or conical body 146 terminating at a radial flange 148. An end 150 of the coil is threaded through the payout tube. It will be understood that the payout tube can be placed in the radial hole 142 of the coil 138 either before or after placing the coil on the right side panel 96. It will also be noted that the coil is placed on a flat, completely open surface formed by the right side panel. As such, the coil need not be lifted over any standing sides of an enclosure, nor need the coil be lowered into an enclosure. Instead of putting the coil down into an enclosure, the coil is laid on an open space and the enclosure is going to be placed around the coil. This affords a far simpler procedure that avoids an assembler having to guide and lower the coil into an enclosure through an open side thereof. This greatly reduced the chances of an assembler developing repetitive stress injuries.

Once the coil 138 is in place on the right side panel 96, the doors 56A, 56B are folded open about fold lines MA, MB as shown in FIG. 11. This opens the entryway 53 and readies the clamshell for closing. Prior to that the top and bottom guide flaps are folded up about eleventh fold line 100 and twelfth fold line 102, as indicated by arrows K and L in FIG. 11. The guide flaps may be folded somewhat more than 90°. Doing so will allow the guide flaps to engage the edges of the coil and constrain any loose strands. This prevents any stray coil strands from interfering with closure of the clamshell. In a sense this means the first movements of carton surfaces relative to the coil are radial movements of the guide flaps, rather than axial or tangential movements of the clamshell. The radial movements of the guide flaps easily gather and constrain the coil. The guide flaps then act as a funnel for guiding the closure of the clamshell. The height h of the guide flaps is at least 80% of the depth D of the clamshell. Because the flaps are nearly as high as the clamshell walls they are able to constrain the strands of any coil that will fit in the clamshell. Guide flaps shorter than the 80% of the depth are incapable of performing the contraining and funneling function for all size coils.

Figure 12:
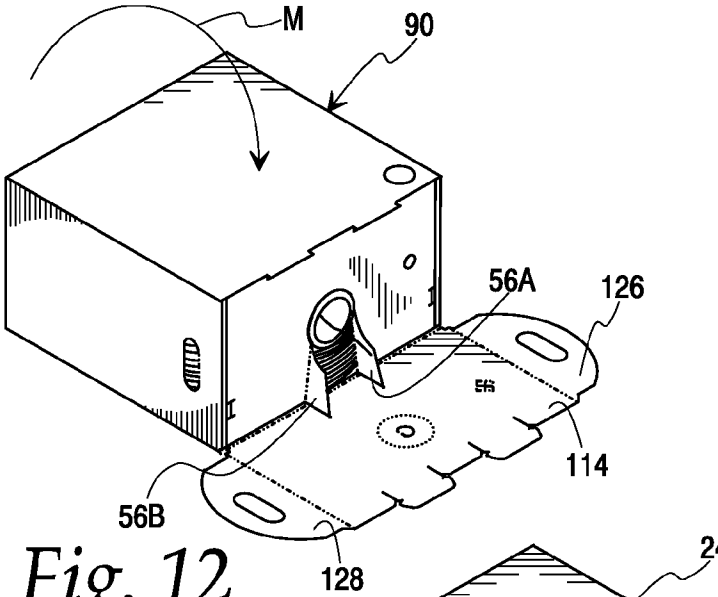
FIG. 12 is a perspective view similar to FIG. 11, showing the clamshell closed over the coil and payout tube.
Figure 13:
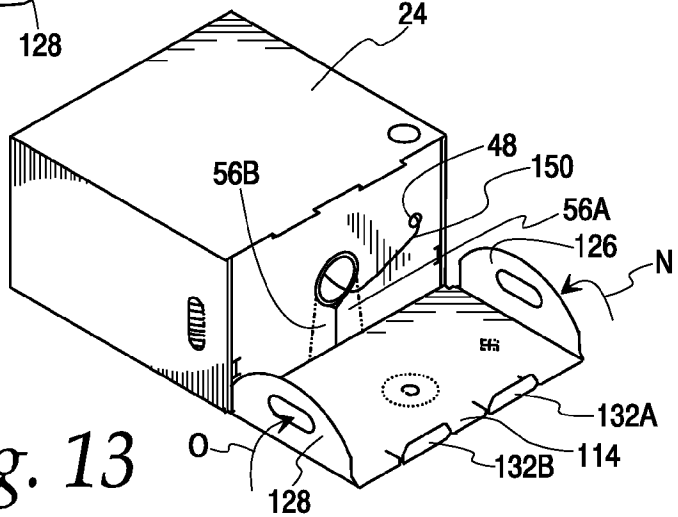
FIG. 13 is a perspective view similar to FIG. 12 showing first steps for closing the cover, namely, folding up the top and bottom tuck flaps, anchoring the wire in the front interior panel, and closing the doors to the payout tube aperture.

The clamshell is closed by folding it in its entirety about thirteenth fold line 112, as indicated by arrow M in FIG. 12. As the clamshell closes it presents the open entryway 53 to the payout tube and allows passage of the clamshell past the body 146 of the payout tube through the open entryway. When the clamshell is fully closed the payout tube retention aperture 50 surrounds the payout tube. The flange 148 of the payout tube rests on the exterior surface of the front interior panel 42. Once the clamshell is closed, the assembler closes the doors 56A, 56B as indicated in FIG. 13. Doing so positively locks the payout tube in the front interior panel and prevents subsequent jostling or vibration of the carton from dislodging the payout tube from its proper location.

Once the clamshell is closed the assembler places the end 150 of the wire into the wire retention hole 48 to prevent loss of the end. The last step is closure of the front exterior panel 114. First, the top and bottom tuck flaps 126, 128 are folded up about fourteenth and fifteenth fold lines 122, 124. This is shown by arrows N and O in FIG. 13. Then the front exterior panel 114 is folded up about sixteenth fold line 134 as shown by arrow P in FIG. 14. The front exterior panel 114 is secured by the closing tabs 132A, 132B fitting into the slits 46A, 46B, respectively. The front exterior panel is also secured by the top tuck flap 126 fitting between the top middle flap 64 and the top outer panel 74. The tuck flap 126 is additionally locked by pressing the finger cushion 79 through openings 68 and 130. Similarly the bottom tuck flap 128 fits between the bottom middle flap 66 and the bottom outer panel 76. The bottom tuck flap 128 is additionally locked by pressing the finger cushion 79 of bottom outer flap 76 through openings 68 and 130 in the bottom middle flap 66 and the bottom tuck flap. It can be seen that this arrangement results in the securement of all three free edges of the front exterior panel. Consequently, the carton is extremely resistant to inadvertent opening if it is dropped. Since the front exterior panel 114 is the last panel closed it can be considered the final panel. It will be understood that other folding sequences might result in a different panel being the final panel.

When a user wants to dispend wire from the carton he or she will first open the front exterior panel 114, extract the end 150 of the wire from the wire retention hole 48 and thread it through the hole 116. Alternately the circular punch out 118 may be removed and the end of the wire threaded through the resulting opening. The front exterior panel 114 is then reclosed. When dispensing of the wire is finished, the new end of the wire may be set in the X-shaped opening 120 of the front exterior panel. As mentioned above, the carton may be mounted on a rod 14 of a rack to support the carton.

While the preferred form of the invention has been shown and described herein, it should be realized that there may be many modifications, substitutions and alterations thereto. For example, while the carton is shown having six, fully-enclosed sides, it could be otherwise. Fewer than six sides could be used if desired. Or one or more of the panels could be shortened so a portion of a side could be partially open. While one embodiment of the carton has been shown as using reinforcing tape, it will be understood that in some applications reinforcing tape is not necessary. Also, while the carton has been described with regard to use with a wire coil, the carton could be used with other types of filamentary materials, such as rope.

I claim:

1. A carton for receiving a coil of filamentary material and a payout tube, the carton comprising:

a clamshell having a plurality of panels, the panels collectively defining a coil-receiving enclosure, the clamshell having an open side;

a cover for selectably closing said open side of the clamshell;

the clamshell having a payout panel which defines an entry edge and an aperture remote from the entry edge, the aperture being sized to permit a portion of the payout tube to extend therethrough, the payout panel being located such that when the clamshell is assembled and the cover is disposed perpendicularly to the open side of the clamshell the payout panel is parallel to and spaced from the cover;

an entryway defined in said payout panel, the entryway extending from the entry edge of said payout panel to the aperture, the entryway being sized to permit said portion of the payout tube to extend therethrough; and at least one door connected to the payout panel for movement between an open position, wherein the entryway permits passage of the payout tube from said entry edge to the aperture, and a closed position, wherein the door prevents passage of a payout tube from the aperture;

one of the cover and clamshell having a final panel which is the last panel to be closed on a filled carton, the final panel having a plurality of edges each of which includes a locking member which positively interlocks with the other of the cover and clamshell, such that the carton is free of glue joints, and wherein at least one of the edges of the final panel includes a tuck flap with a hand hold opening therein and said other of the cover and clamshell includes a finger cushion which is foldable into said hand hold opening.

2. The carton of claim 1 wherein the payout panel includes an access slit and door fold lines on either side of the access slit to define two doors that pivot about the door fold lines.

3. The carton of claim 1 wherein the clamshell has a closed side opposite the open side and the distance from the open side to the closed side defines the depth of the clamshell and wherein the cover includes a main plate having first and second guide flaps connected thereto by fold lines, at least a portion of each guide flap having a height from a free edge thereof to its fold line that is at least 80% of the depth of the clamshell.

* * * * *